US005511372A

United States Patent [19]

Liedgens

[11] Patent Number: 5,511,372

[45] Date of Patent: Apr. 30, 1996

[54] TRANSPORT VEHICLE FOR SLIVER CANS

[75] Inventor: Hans-Peter Liedgens, Mönchengladbach, Germany

[73] Assignee: W. Schlafhorst AG & CO, Moenchengladbach, Germany

[21] Appl. No.: 276,168

[22] Filed: Jul. 15, 1994

[30] Foreign Application Priority Data

Jul. 15, 1993 [DE] Germany ..... 43 23 726.6

[51] Int. Cl.[6] ..... D01H 9/10; D01H 9/14

[52] U.S. Cl. ..... 57/281; 19/159 A; 57/90; 57/268; 57/271; 57/272; 414/280; 414/661

[58] Field of Search ..... 57/90, 281, 266, 57/268, 271, 272; 19/159 A; 414/661, 280

[56] References Cited

FOREIGN PATENT DOCUMENTS

| | | |
|---|---|---|
| 2536435 | 2/1984 | Germany . |
| 8812622.6 | 3/1990 | Germany . |
| 4018088 | 1/1991 | Germany . |
| 4132819 | 4/1992 | Germany . |
| 9202136.0 | 6/1992 | Germany . |
| 86/06358 | 11/1986 | WIPO . |
| 91/18135 | 11/1991 | WIPO . |

*Primary Examiner*—William Strysewski
*Attorney, Agent, or Firm*—Herbert L. Lerner; Laurence A. Greenberg

[57] ABSTRACT

A transport vehicle transports a plurality of sliver cans between a can delivery station, work stations of a sliver processing textile machine, and a discharge station for empty cans along a given travel direction. The vehicle includes an undercarriage with a plurality of can parking places for the sliver cans. A plurality of can exchange mechanisms are provided, one for each can parking place. Each exchange mechanism includes a carriage supporting a respective one of the sliver cans. The carriage is slidable on the under-carriage transversly to the travel direction of the transport vehicle. A motor slidingly drives each of the carriages on the undercarriage. A can manipulating device, which is operatively associated with each of the carriages, displaces the sliver cans, setting them down and receiving them on a respective one of the carriages. The can manipulating device is mechanically coupled with the carriage such that, when the carriage is displaced relative to the undercarriage, the can manipulating device displaces the can relative to the carriage and the can manipulating device reaches an end of the carriage when the carriage reaches a fully shifted position relative to the undercarriage for exchanging the can.

5 Claims, 6 Drawing Sheets

7
10
26
35
37
36
27
23
30
16
25
29
9
8
42
20
39
40
22
32
13e
21
12
24
28
34
31
41
38
15e
13e
8

TRANSPORT VEHICLE FOR SLIVER CANS

BACKGROUND OF THE INVENTION

Field of the Invention

The invention relates to a transport vehicle for sliver cans with a can exchange mechanism for the cans, which travels between a can delivery station, the work stations of at least one sliver-processing textile machine, and a discharge station for empty cans.

A great number of devices have heretofore been proposed with regard to mechanizing and automating the manipulation of the sliver cans in sliver-processing textile machines and also with regard to mechanizing and automating transport of sliver cans between a can delivery station, the work stations of the textile machine and a discharge station for the empty cans. Particularly transport vehicles for sliver cans contribute to making the work of the human operators easier and to adapt the delivery of sliver cans to the automatic mode of operation of the sliver-processing textile machines.

From German Utility Model DE-GM 88 12 622, for instance, an apparatus for changing the sliver cans in a spinning machine is known. With that apparatus, cans in particular that can be deposited below a work station and have virtually the same width as such a work station are transported. These are so-called rectangular cans, which are longer than they are wide. Transport vehicles for sliver cans must be built in such a way that they can pass between the sliver-processing textile machines and moreover can perform an automatic change of sliver cans in the corridors between machines.

Particularly with such rectangular cans, the space between the machines can cause problems in manipulating the cans. The prior art apparatus takes up a great deal of space, for instance. To assure perfect manipulation of the cans, the undercarriage of that prior art apparatus must be wider than the cans placed on it. The manipulating apparatus for receiving and setting down the cans and for displacing the cans beneath the work stations is embodied so that it can manipulate only one can at a time. To manipulate a can, it must therefore be driven to it first and then positioned above it.

SUMMARY OF THE INVENTION

It is accordingly an object of the invention to provide a transport vehicle for sliver cans, which overcomes the hereinafore-mentioned disadvantages of the heretofore-known devices of this general type and which enables fast and efficient can exchange, and whose width does not substantially exceed the width of the cans to be transported. With the foregoing and other objects in view, there is provided, in accordance with the invention, a transport vehicle for transporting a plurality of sliver cans between a can delivery station, work stations of a sliver processing textile machine, and a discharge station for empty cans, the transport vehicle traveling in a travel direction, comprising: an undercarriage defining a plurality of can parking places for sliver cans; a plurality of can exchange mechanisms, each including a carriage supporting a respective one of the sliver cans, said carriage being slidable on said undercarriage transversly to a travel direction of the transport vehicle; motor means for slidingly driving each of said carriages on said undercarriage; and a can manipulating device operatively associated with each of said carriages for displacing the sliver cans, setting them down and receiving them on a respective one of said carriages; and mechanical coupling means coupling said can manipulating device with said carriage such that, when said carriage is displaced relative to said undercarriage, said can manipulating device displaces the can relative to the carriage and said can manipulating device reaches an end of said carriage when said carriage reaches a fully shifted position relative to said undercarriage for exchanging the can.

The advantages of the transport vehicle according to the invention are that because of the can exchange mechanism, with its carriages for supporting a can that are displaceable perpendicular to the direction of motion of the transport vehicle, the transport vehicle can observe an optimal spacing from the work stations of the textile machine. Problems in the region of the work stations, particularly in sliver feeding, from a can manipulator disposed above the cans are accordingly precluded. According to the invention, one displaceable carriage is disposed beneath each can on the transport vehicle. If the transport vehicle according to the invention is loaded with freshly filled sliver cans, then it is called to a textile machine at which an empty can is to be exchanged for a full can. On the transport vehicle, except for one empty space, all the carriages are occupied with full sliver cans. The transport vehicle positions itself first with the empty space in front of the textile machine work station at which an empty can is to be changed. The empty carriage is displaced, perpendicular to the direction of motion of the transport vehicle, in the direction toward the empty can to be received. At the same time, the apparatus for receiving the can is set in motion. The carriage is moved far enough that the apparatus can engage the empty can. The travel distances of the carriage and of the apparatus for receiving the can are adapted to the spacing between the rail-borne transport vehicle and the can, in such a way that in the terminal position of the carriages, the apparatus for receiving the can is just able to engage the can. Once the can is engaged, the procedure continues in the opposite direction. The carriage is retracted again and at the same time the apparatus moves in such a way that the can is pulled onto the carriage. Once the carriage has reached its terminal position, the sliver can is fully positioned on the carriage and thus on the transport vehicle as well.

Once the empty can is received, the transport vehicle moves onward by one indexing distance, i.e. by the width of one can, so that a carriage with a full sliver can is opposite the empty space. The positioning is done as in the takeover of the empty can, with the aid of known positioning devices, for instance as known from the aforementioned Utility Model DE-GM 88 12 622. The full sliver can is now set down below the work station. To that end, the carriage with the full sliver can moves, and at the same time the apparatus on the carriage pushes the sliver can away from this carriage. When the carriage has been extended to its outermost position, then the can has also been pushed all the way away from the carriage and set down beneath the work station. The carriage is retracted again, whereupon the apparatus for displacing the can returns to its outset position. The transport vehicle is put in motion to another work station, where it will perform an exchange of an empty can for a can full of sliver. The empty can of the next work station requiring a full can is then loaded onto the now-created empty space of the transport vehicle.

Because there is one apparatus for displacing, setting down and receiving a can at each carriage, or in other words at each can parking place, all the empty cans can be discharged simultaneously at the empty can discharge station. If the can exchange mechanism for cans of the transport vehicle is arranged so that it displaces the carriages to both the right and the left, perpendicularly to the direction of motion of the transport vehicle, then it is possible for the empty cans to be set down on the right-hand side of the transport vehicle, for instance, and then for the cans freshly filled with sliver to be taken up on the left side of the transport vehicle. The transport vehicle accordingly does not have to change its location in order to discharge the empty cans and take up the cans freshly filled with sliver. The discharge station for the empty cans and the can delivery station can be disposed next to one another in such a way that the transport vehicle can move in between the two stations for can changing. Supplying opposed work stations of two adjacent textile machines with sliver cans is moreover possible if the spacing between the parallel machines does not exceed the displacement path of the carriages.

The transport vehicle according to the invention is especially suitable for transporting rectangular cans. To enable optimal utilization of space on the transport vehicle and the simplest possible manipulation of the cans, the rectangular cans stand in line one after the other, broadside to broadside in terms of the direction of travel of the vehicle, each on its own carriage.

As a rule, rectangular cans are each used to supply one spinning station with sliver. The dimensions of the rectangular cans are such that the width of one rectangular can is approximately equivalent to the width of one work station at the sliver-processing textile machine. To make can changing at the work stations as efficient as possible and to simplify positioning, the arrangement of carriages on the vehicle corresponds to the distribution of work stations in the textile machine to be supplied with cans.

In a further feature of the invention, the apparatus for manipulating a can is mechanically coupled to the carriage in such a way that in the displacement of the carriage relative to the undercarriage of the vehicle, the apparatus displaces the can relative to the carriage. This considerably speeds up can changing, without risk of impairing a stable positioning of the transport vehicle or of the can. Moreover, a separate drive for the apparatus for manipulating the can is not needed. The extension of the carriage and the spacing of the transport vehicle from the retaining devices for the cans that are disposed beneath the textile machine work stations are adjusted in such a way that the can is supported without any gaps while it is being set down and while it is being taken up, i.e. received. The carriage can extend to beneath the devices that pick up the cans and position them under the work stations. It is even conceivable to support the carriages on these devices, which would completely avert any possible tilting torque acting on the transport vehicle upon transfer of cans or takeup of cans.

The apparatus displacing a can on a carriage and for picking up and setting down a can may be secured to an endless revolving pulling means. This pulling means may for instance be an endless toothed belt, which is guided over deflection rollers and which extends along the carriage and is equipped with drivers for the cans. The endless revolving pulling means may be secured to the frame of the transport vehicle, so that upon a motion of the carriage, the pulling means are necessarily carried along as well. During the movement of the carriage, the carriage and the pulling means move relative to one another but in the same direction. The length of the carriage and the fastening point of the pulling means to the vehicle frame are definitive for the possible displacement travel of the carriage and for the point reachable by the particular driver moving the can. Securing the pulling means to the vehicle frame and coupling a driver to the carriage via a toothed belt is advantageous, because of the simple construction, whenever loading and unloading of the vehicle is to be done from only one side.

In another embodiment of the invention, the drive for a carriage is coupled with the apparatus for displacing the can on the carriage and for setting the can down from this carriage and picking up the can onto this carriage, in such a way that a previously defined ratio is brought about in the relative motion between a driver for the can and the carriage. If this driver is located on a pulling means, for instance again on an endless toothed belt, then in that case it is not secured to the frame of the vehicle. It revolves on the carriage, and its drive is effected via the drive of the carriage, with the interposition of a step-up gear for adapting the relative motion.

The relative motion of the carriage and pulling means can be adapted to one another in such a way that upon extension of the carriage to the discharge or takeover positions of one can, a driver of the pulling means reaches the end of the extended carriage, in order to push one can all the way downward from a carriage or to pick up one can. Various options are available for driving the carriage. For instance, the carriage may be driven for loading and unloading on both sides by means of an endless toothed belt; the drive wheel is then disposed centrally on the frame of the transport vehicle and is guided about two deflection rollers on the carriage. It is also conceivable, however, to effect the displacement via a pinion-driven rack, a recirculating ball spindle, a threaded spindle, or a pneumatic or hydraulic cylinder.

Instead of drivers engaging the lower edge of the can, which are mounted on the pulling means and either push or pull the can, the apparatus for picking up and setting down a can may have can retaining means that engage the can. By way of example, these means may be suction cups, which engage the can wall and exert suction on the can wall as the can is pulled onto the carriage. The retaining means may also be hooks or pins that engage or lock into eyelets mounted on the cans.

In another feature, the retaining means may be a magnet, which enters into operative connection with a magnetizable material attached to the can. By way of example, this magnet may be an electromagnet, which is turned on to manipulate the cans and is turned off again once can manipulation has ended. Retaining means for the cans may advantageously be used whenever pickup and setting down of the cans from the transport vehicle is done only to one side. Since these retaining means move only on the top of the frame of the transport vehicle, the transport vehicle can have very slight clearance at the bottom, which is advantageous in terms of the height and hence the filling content of the cans. Other features which are considered as characteristic for the invention are set forth in the appended claims.

Although the invention is illustrated and described herein as embodied in a transport vehicle for sliver cans, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
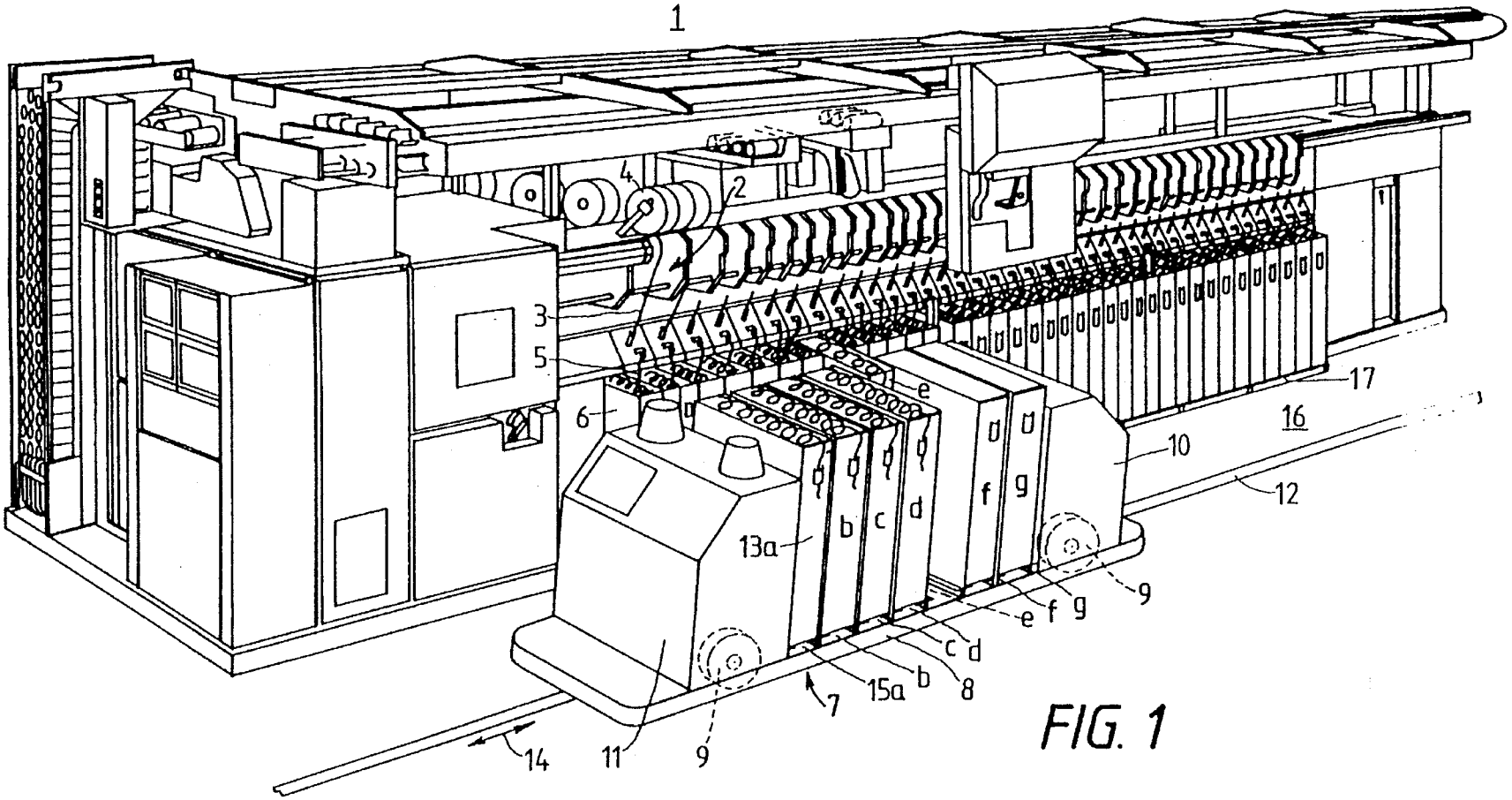
FIG. 1 is a schematic, perspective view of an open-end spinning machine, with a transport vehicle according to the invention located in front of it, during the change of a sliver can at a spinning station.

Referring now to the drawings in detail, and first, particularly, to FIG. 1 thereof, there is seen a schematic rendition of an open-end spinning machine 1, representing a textile machine that processes sliver. The machine includes a number of spinning stations 2 located next to one another. In each of these spinning stations, yarn 3 is spun, which is wound up onto cross-wound bobbins or cheeses 4. In a known manner, the yarn is spun from sliver 5 that is fed from sliver cans 6 into the spinning stations 2. Each spinning station 2 is assigned one can 6. The cans stand next to one another beneath the spinning stations. The cans have an elongated rectangular form so that the cans can be disposed beneath the spinning stations without difficulty. Each can is approximately the same width as one spinning station. The function of an open-end spinning machine will not be described further here, because it is not the subject of the invention and is well known to those of skill in this art.

A transport vehicle 7 is located in front of the spinning machine. At a spinning station, it is just now exchanging an empty sliver can for a filled one. The transport vehicle 7 comprises an undercarriage 8 with wheels 9. The vehicle has a rectangular outline, and on one short side on its undercarriage frame it carries a drive mechanism 10, with a motor that drives the wheels 9, and a control unit 11 that processes the control commands and controls the can exchange.

By means of an induction loop 12, the transport vehicle 7 is guided along the spinning machine 1 and from there to a non-illustrated discharge station for the empty cans, to a non-illustrated can delivery station for full sliver cans, and optionally to other spinning machines, which are also not shown here. It should be understood to transmit the control commands by radio signals.

In the present exemplary embodiment, the transport vehicle 7 has seven parking places 15*a*–15*g* for rectangular cans. In terms of the travel direction 14 of the transport vehicle 7, the rectangular cans 13*a*–13*g* are located adjacent one another, broadside to broadside. The sliver can 13*e* is just now being pushed under a spinning station. The cans 13*f* and 13*g* standing on the parking places 15*f* and 15*g* are empty cans, which have already been exchanged for full cans at other spinning stations. The cans 6 of the textile machine 1 are raised somewhat above the floor 16 on a pedestal 17. This makes can changing easier for the can exchange mechanism according to the invention of the transport vehicle and laterally guides the can.

Figure 2:
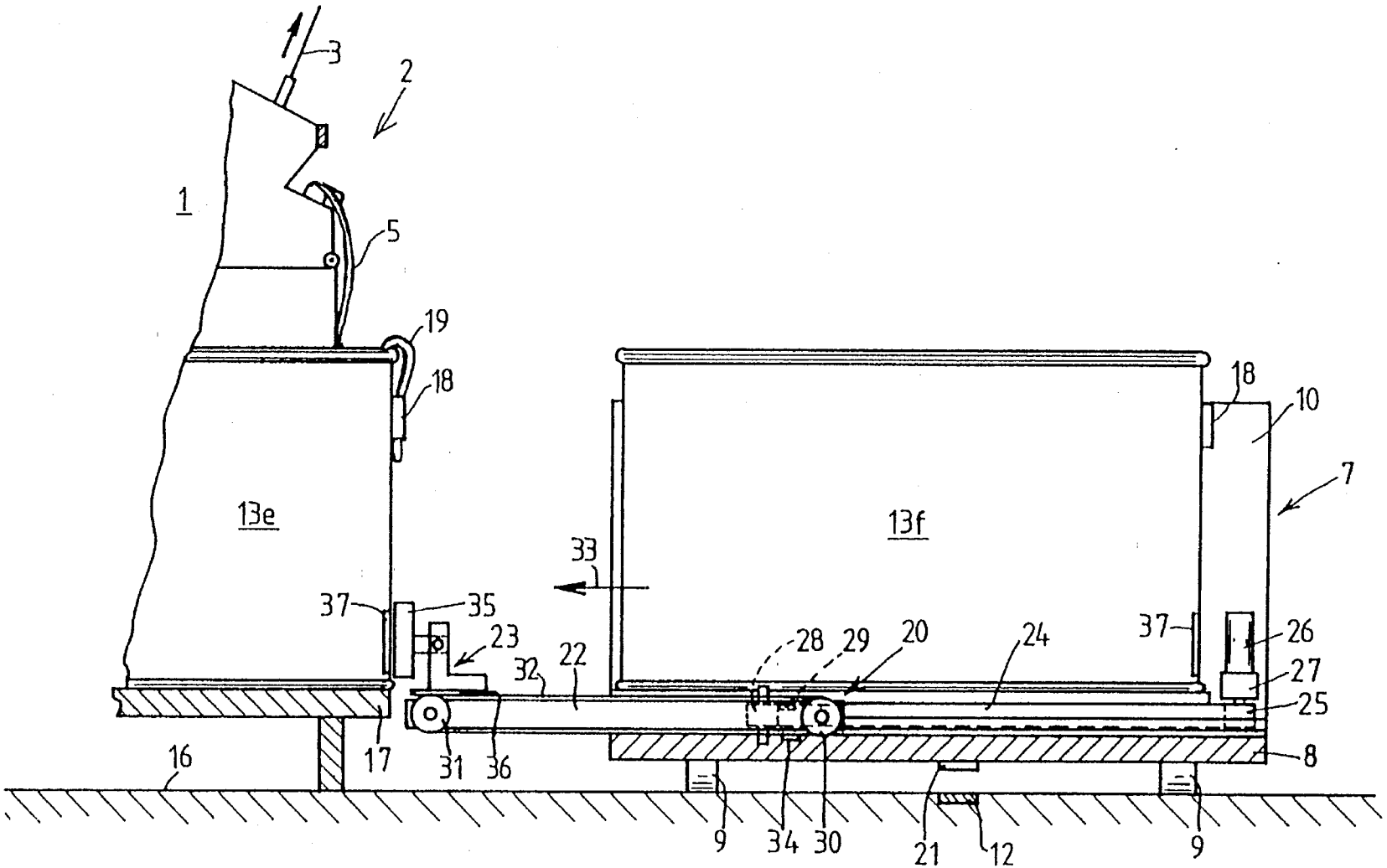
FIG. 2 is a cross-section through the transport vehicle standing at the spinning station.

FIG. 2 shows a section through the transport vehicle 7 between two cans, in this case between the cans 13*d* and 13*e*, perpendicular to the direction of travel 14 of the transport vehicle 7. The section is taken at the point of the transport vehicle where in FIG. 1 a can filled with sliver is just now being pushed under a spinning station. Of the spinning machine 1, one spinning station 2 is schematically shown on the left in FIG. 2. While at the spinning station above the replaced can 13e sliver is not as yet being fed, in the spinning station located behind it (in terms of the direction of view), sliver 5 is being fed from a can into the spinning station 2 and spun there into a yarn 3, which is drawn off in the direction of the arrow and taken for winding up on the bobbin 4. The sliver can 13*e* that is just now set down below the spinning station still carries in its sliver clamp 18 the beginning end 19 of sliver from the freshly filled can. This sliver beginning end 19 is introduced into the spinning station by a non-illustrated device. The sliver can 13*f* set down on the transport vehicle 7 is already empty, as indicated by its empty sliver clamp 18.

Because of the section taken through the transport vehicle 7, the can exchange mechanism 20 for the sliver can in the position 13*e* is illustrated. This can exchange mechanism 20 rests on the undercarriage frame 8, shown in section here. Also visible are the two wheels 9 and the receiver 21, oriented toward the floor 16 below the undercarriage 8, for receiving the signals from the induction loop 12.

The can exchange mechanism 20 is provided on the transport vehicle 7 for each location of a can. It essentially comprises one carriage 22, displaceable relative to the undercarriage 8 perpendicular to the direction of travel 14 of the transport vehicle, and one can manipulating device 23 for displacing a can on the carriage 22, for setting the can down from this carriage 22, and for taking up a can onto the carriage 22. The carriage 22 rests displaceably on the undercarriage 8. The displacement is effected by means of a toothed belt 24. The toothed belt 24 revolves around a driven deflection roller or guide roller 25, which is permanently joined to the undercarriage 8 and which is driven by means of a motor 26 via a transmission gear 27. The belt 24 is guided around a further deflection roller 28 rotatably secured to the undercarriage 8. A clamp 29 connects the carriage 22 to the toothed belt 24. Since in the present exemplary embodiment of FIG. 2 the can exchange mechanism 20 for changing the cans is arranged only for changing the can to one side, in this case to the left, the connection 29 between the carriage 22 and the toothed belt 24 is mounted on the right-hand side of the carriage 22.

The carriage 22 carries one deflection roller 30 and 31 on its right and left ends, respectively. A toothed belt 32 is wrapped around these two deflection rollers 30 and 31. Viewed in the outward-thrust direction 33 of the carriage 22, a fastening 34 of the toothed belt 32 to the undercarriage 38 is located just before the deflection roller 28. The toothed belt 32 is part of the apparatus 23 for displacing a can on the carriage 22. To that end, the apparatus 23 further includes a means 35 for manipulating a can. It is supported slidingly on the carriage 22 and as identified by reference numeral 36 is firmly joined to the toothed belt 32. In the present exemplary embodiment, the means 35 for manipulating the cans is a magnet that can be turned on. It enters into operative connection with a magnetizable metal plate 37 mounted on the face end of the cans, for instance if an empty can under the spinning station 2 is to be pulled away onto the transport vehicle 7. When a can is pushed underneath from the transport vehicle, the magnet need not be turned on.

The exemplary embodiment of FIG. 2 shows the terminal position of the apparatus 23 for displacing the can on the left end of the extended carriage 22, which is likewise in its farthest-extended position. The travel paths of the carriage 22 and apparatus 23 are each determined by the points at which the toothed belt 24 is fastened to the carriage 22 and the toothed belt 32 is fastened to the undercarriage 8, as well as by the length of the carriage 22 and the spacing between the two deflection rollers 25 and 28.

Figures 3, 4:
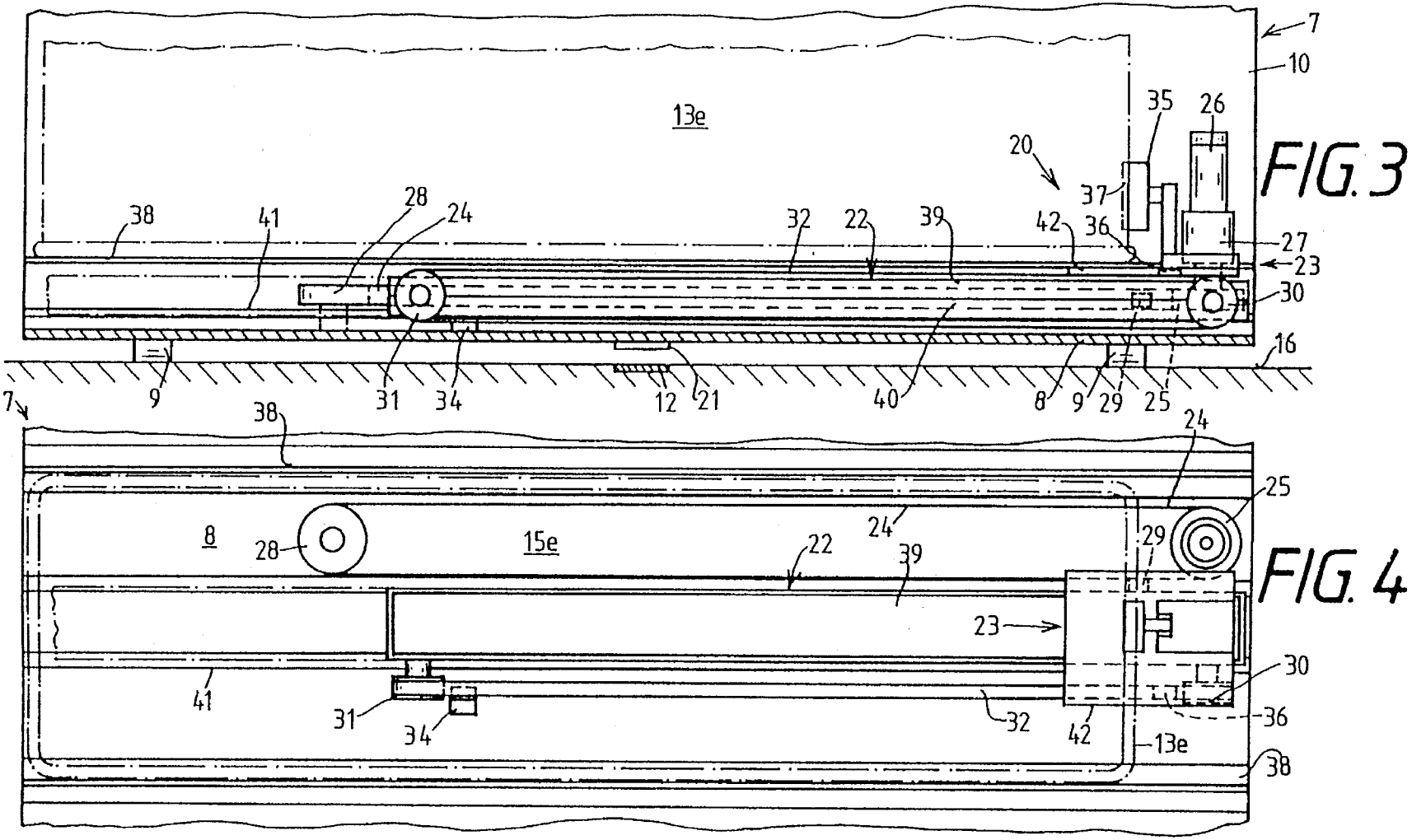
FIG. 3 is a partial, side-elevational view of the can exchange mechanism with the drive device for the carriage and the apparatus for displacing the cans on the carriage and for setting down and picking up the cans.
FIG. 4 is a top-plan view onto the parking place of a can according to FIG. 3.
Figure 5:
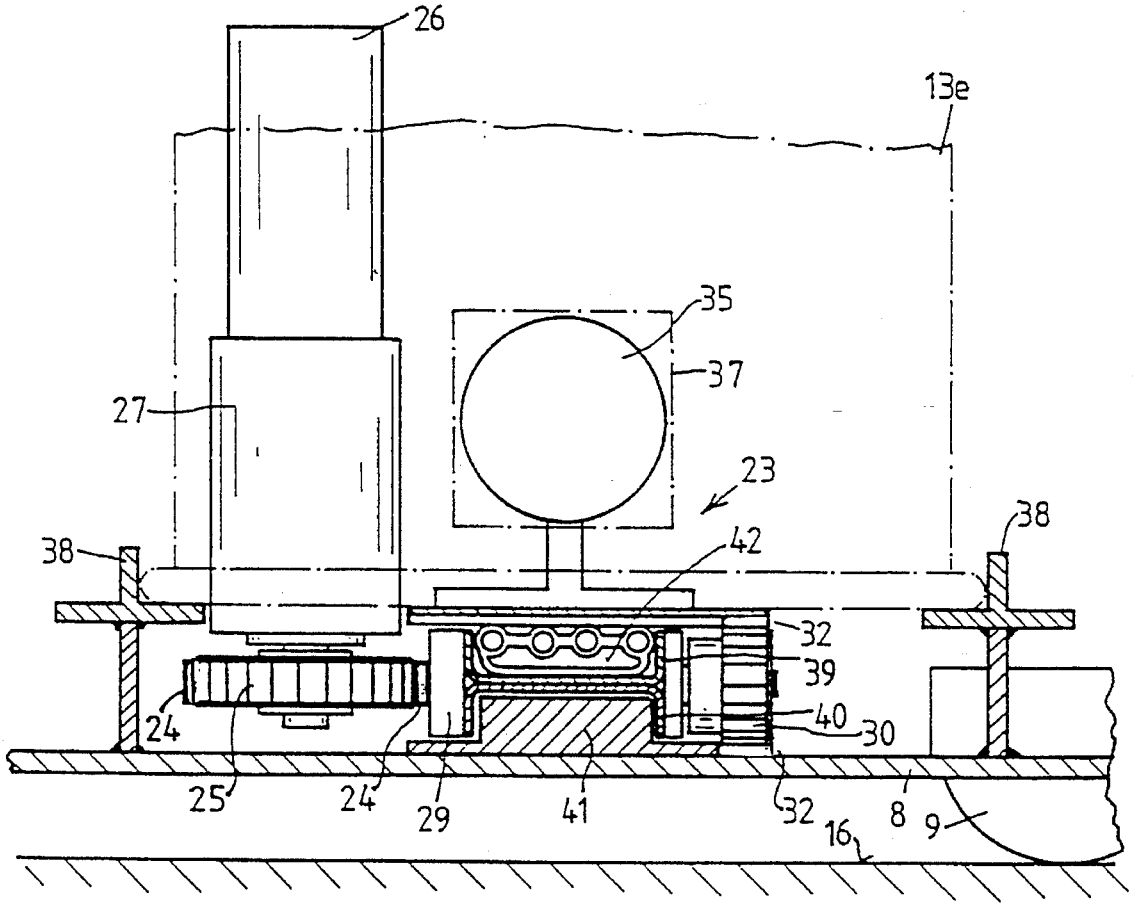
FIG. 5 is a partial elevational view of the can exchange mechanism, seen on the drive side.

The can exchange mechanism 20 of a parking place of a can on the transport vehicle is shown in detail in FIGS. 3, 4 and 5 and will be described in further detail with reference thereto. FIG. 3 shows a side view of the can exchange mechanism 20, corresponding to FIG. 2, in the outset position with a sliver can standing thereon. FIG. 4 shows a plan view on the can parking place, and FIG. 5 shows an elevational view of the drive side of the can exchange mechanism.

In FIG. 3 the can 13e is still standing on the carriage 22 of the can exchange mechanism 20. The apparatus 23 for displacing a can is in its outset position, and with an electromagnet 35 it holds the can 13*e* by contact with the metal plate 37 in the face end of the can. The metal plate 37, as mentioned above, comprises a magnetizable material.

From FIG. 4 it can be seen that the carriage 22, on which a can stands, in the present case the can 13*e*, does not completely fill the parking place of one can on the transport vehicle 7. The can is supported on each of its long sides by guide rails 38, which in cross section have the profile of an upside-down T (FIG. 5).

In the present exemplary embodiment, the can exchange mechanism 20 is provided for changing a can only on one broad side of the transport vehicle. The dimensions of the carriage 22 in its length influence the distance that the apparatus for displacing the can and for taking up and setting down a can covers, since a fixed coupling exists between the carriage 22 and this apparatus 23. In the present exemplary embodiment, the dimensions of the carriage 22 are chosen such in terms of its length that as can be seen from FIG. 2, upon transfer or takeover of a can, the apparatus 23 is located at the end of the extended carriage 22.

With reference to FIG. 5, the displaceable carriage 22 comprises two U-shaped profiles 39 and 40 resting on one another facing in opposite directions. The U-shaped profile 40 fits around and slides on the guide rail 41, which is secured to the undercarriage 8. The U-shaped profile 39 serves to guide the apparatus 23 for displacing the can and for taking up and setting down the can. The apparatus 23 rests on a roller circulation shoe 42, which is movably supported inside the U profile 39 (FIG. 5).

Figure 7:
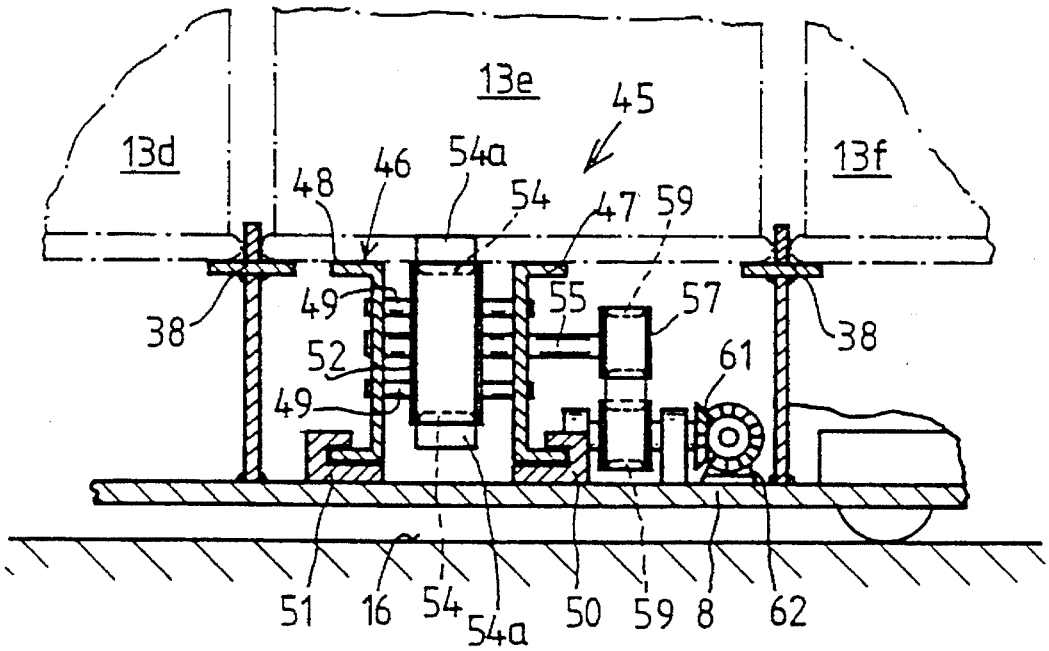
FIG. 7 is a partial, elevational view of the can exchange mechanism, seen on the drive side.
Figure 8:
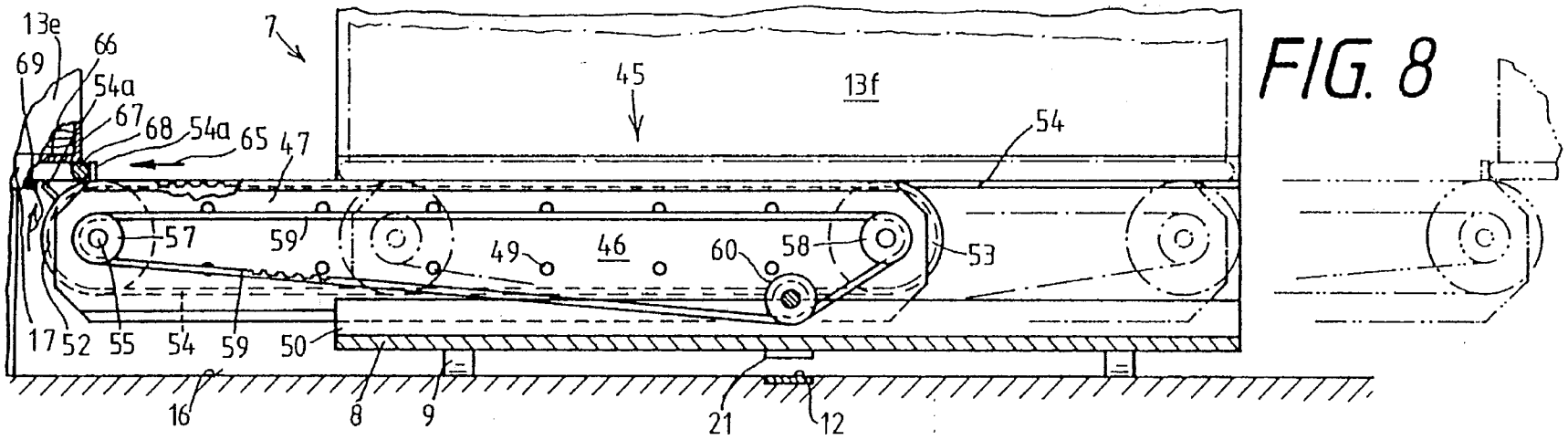
FIG. 8 a partial, side-elevational view of the can exchange mechanism during the transfer of a full sliver can at a work station of a textile machine.
Figure 6:
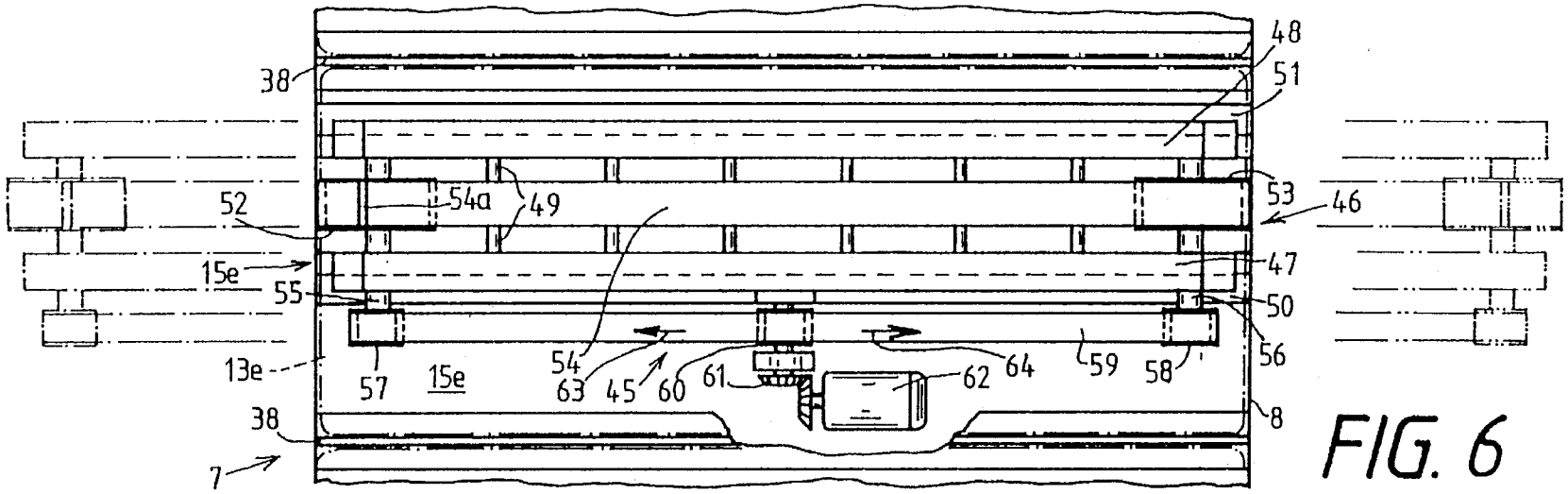
FIG. 6 is a top-plan view on a can exchange mechanism that makes it possible to change cans on both sides of the transport vehicle.

FIGS. 6, 7 and 8 illustrate a further exemplary embodiment of the invention. All the characteristics that match the preceding exemplary embodiment are identified by the same reference numerals. In the present exemplary embodiment, the can exchange mechanism 45 is embodied such that loading and unloading of the cans onto or from the transport vehicle 7 can be done on both the right and the left sides. To that end, however, the carriage 46 must be extensible both to the right and to the left, as suggested in dot-dashed lines in FIG. 6. This dictates a configuration of the carriage drive and of the drive of the apparatus for displacing, taking up and setting down a can, that differs from the preceding exemplary embodiment.

With reference to FIG. 7, the carriage 46 comprises two U-shaped profiles 47 and 48, which are joined in a spaced-apart relationship by cross bars 49. Two U-shaped guide rails 50 and 51 are disposed on the undercarriage 8 of the can cart 7; each of these rails guides one of the legs 47 and 48 of the U profiles of the carriage 46. Deflection rollers 52 and 53 are disposed on both face ends between the two U profiles 47 and 48 of the carriage 46. An endless toothed belt 54 wraps around the deflection rollers. This toothed belt is equipped with drivers 54*a*, with which the cans can be manipulated, as will be described in further detail in conjunction with the description of FIG. 8.

The shafts 55 and 56 of the deflection rollers 52 and 53, respectively, are extended laterally out of the carriage 46 and each carries a further deflection roller 57 and 58, respectively. An endless toothed belt 59 wraps around the deflection rollers 57 and 58. The toothed belt wraps around a further wheel 60, which is rotatably secured to the undercarriage 8 centrally of the parking place 15*e* of the can 13*e*. This wheel is coupled to a gear 61 that is driven by a motor 62.

The toothed belt 59 is carried along in the direction of rotation of the drive wheel 60, whichever it may be, and thus rotates the deflection rollers 57 and 58. They transmit their rotary motion to the deflection rollers 52 and 53 in the same rotational direction. Because the diameter of the deflection rollers 57 and 58 differs from that of the deflection rollers 52 and 53, a previously determinable relative motion of the toothed belt 54 relative to the carriage 46 when the carriage 46 is extended to the right or to the left can be established. If the toothed belt 59 moves in the direction of the arrow 63, then the carriage 46 likewise moves to the left, in the direction of the arrow 63. At the same time, the toothed belt 54 is driven and likewise moves in the same direction. However, because of a different gear ratio given a larger deflection roller 52 compared with a smaller deflection roller 57, the toothed belt 54 is transported at a higher speed than that with which the carriage 46 is moved relative to the undercarriage 8. The same remarks apply if the toothed belt 59 moves in the direction of the arrow 64. The motion of the carriage 46 and the toothed belt 54 can be adjusted to one another such that in the final position of the extended carriage 46, the drivers 54*a* on the toothed belt 54 have pushed the can standing on the carriage 46 all the way off.

That situation is shown in FIG. 8. The situation shown there is equivalent to the transfer of a full can to the spinning machine as shown in FIG. 2. The carriage 46 has been extended in the direction of the arrow 65 to the transfer position. In the process, the toothed belt 54 has moved far enough that a cam or driver 54*a* disposed on the belt has pushed the can 13*e* onto the pedestal 17. In FIG. 8, the can 13*e* is shown cut away in the region of the bottom. The can bottom 66 and the can wall 67 are united in a bead 68, which rests on the guide rails 38 or on the pedestal 17. If the can exchange mechanism 45 presented in this exemplary embodiment is to be able to work, the drivers 54*a* must be able to engage the bead 68 from behind when an empty can is pulled out from the pedestal 17 under the can bottom. For this reason, the cans protrude somewhat beyond the pedestal 17 in the sliver-processing textile machine.

In FIG. 8, the can 13*e* has been set down under a work station of a sliver-processing textile machine. The toothed belt 54 is stopped whenever a driver 54*a* has just set down the can that was to be set down, and is still in the vertical position. This position can be monitored by non-illustrated sensors, for example. From the position shown in FIG. 8, the carriage 46 is retracted into its outset position inside the transport vehicle 7.

If an empty can is to be retrieved from a work station, then the carriage 46 again moves to the position shown in FIG. 8. After that, the toothed belt revolves in the direction of an arrow 69, so that a driver 54*a* below the bottom 66 strikes the bead 68 of the empty can and pulls it into the carriage 46, which at the same time is retracted into its outset position on the transport vehicle 7. The speeds of the toothed belt 54 and of the carriage 46 relative to the undercarriage can be adapted to one another such that when the outset position of the carriage 46 is reached, the empty can is positioned completely on the parking place 15*e* on the transport vehicle. The spacing of the drivers 54*a* on the toothed belt 54 is chosen in accordance with the travel distance of the carriage 46 and the gear ratio of the two deflection rollers 52 and 57 or 53 and 58. The transfer of a can on the right-hand side is suggested in dash-dotted lines.

With a can exchange mechanism as presented in FIGS. 6–8, the transfer of empty cans and the takeup of freshly filled sliver cans can be speeded up considerably. To that end, the discharge stations for the empty cans in the can delivery stations can be disposed adjacent one another, in such a way that the transport vehicle 7 with its empty cans moves between the two opposed stations. After its positioning, all the empty cans located on the transport vehicle are simultaneously transferred to the empty can discharge station by the respective can exchange mechanism. Next, all the carriages are extended to the opposite side for simultaneous takeover of all the cans that are ready at the can delivery station. The can change sketched here enables a considerable savings in loading and unloading time at the discharge station and the can delivery station.

I claim:

1. A transport vehicle for transporting a plurality of sliver cans between a can delivery station, work stations of a sliver processing textile machine, and a discharge station for empty cans, the transport vehicle traveling in a travel direction, the transport vehicle comprising:

an undercarriage defining a plurality of can parking places for sliver cans on the transport vehicle;

a plurality of can exchange mechanisms, each including a carriage supporting a respective one of the sliver cans, said carriage being slidable on said undercarriage transversely to a travel direction of the transport vehicle;

motor means for slidingly driving each of said carriages on said undercarriage; and a can manipulating device operatively associated with each of said carriages for displacing the sliver cans, setting them down and receiving them on a respective one of said carriages; and mechanical coupling means coupling said can manipulating device with said carriage such that, when said carriage is displaced relative to said undercarriage, said can manipulating device displaces the can relative to the carriage and said can manipulating device reaches an end of said carriage when said carriage reaches a fully shifted position relative to said undercarriage for exchanging the can.

2. The transport vehicle according to claim 1, wherein said carriage with said can manipulating device is displaceable transversely to the direction of travel of the transport device towards both sides of the travel direction.

3. The transport vehicle according to claim 1, wherein said can manipulating device includes means for displacing a can disposed on said carriage, and means for receiving and setting down a can in the form of an endless revolving pulling means with drivers for a can.

4. The transport vehicle according to claim 1, wherein said can manipulating device includes retaining and entraining means engaging the can.

5. The transport vehicle according to claim 4, wherein said retaining and entraining means is a magnet for operatively engaging a magnetizable material attached to the can.

* * * * *